US006112480A

United States Patent [19]

Turner

[11] Patent Number: 6,112,480

[45] Date of Patent: Sep. 5, 2000

[54] MODULAR STAIRCASE

[76] Inventor: Scott A Turner, 550 Ashmont St., Greensboro, N.C. 27410

[21] Appl. No.: 08/992,778

[22] Filed: Dec. 17, 1997

Related U.S. Application Data

[63] Continuation of application No. 08/592,640, Jan. 26, 1996, Pat. No. 5,720,136.

[51] Int. Cl.[7] ..... E04F 11/00

[52] U.S. Cl. ..... 52/182; 52/187; 52/188; 52/191

[58] Field of Search ..... 52/182, 187, 188, 52/191

[56] References Cited

U.S. PATENT DOCUMENTS

| | | | |
|---|---|---|---|
| 4,635,416 | 1/1987 | Ayala | 52/188 |
| 4,798,030 | 1/1989 | Molinazzi | 52/188 |
| 4,869,034 | 9/1989 | Hammond | 52/184 |
| 4,918,799 | 4/1990 | Benedetti | 29/467 |
| 5,058,339 | 10/1991 | Krstovic | 52/187 |
| 5,123,210 | 6/1992 | Schmidt | 52/182 |
| 5,163,491 | 11/1992 | Smith | 144/353 |
| 5,309,687 | 5/1994 | Walston | 52/187 |
| 5,347,774 | 9/1994 | Smith | 52/182 |
| 5,402,610 | 4/1995 | Salva | 52/182 |
| 5,502,933 | 4/1996 | Skillern | 52/187 X |
| 5,720,136 | 2/1998 | Turner | 52/182 |

*Primary Examiner*—Beth Aubrey
*Attorney, Agent, or Firm*—Robert W. Pitts

[57] ABSTRACT

A stairway 2 is fabricated using a plurality of load bearing modules 4 that are attached to form a box beam 60 that can be freestanding. Each module 4 included flat vertical front and rear panels 6, 20 that are joined by vertical inside and outside panels 30, 38. The modules are joined by affixing the front panel of a higher module to the rear panel of the next adjacent lower module to form a stepped configuration. For a curved stairway 2, the helical box beam 60 formed of a plurality of trapezoid shaped modules 4 provides the principle support for the weight of the stairway 2 and the weight of any body positioned on the stairway. Longitudinal members 64, 66, 68 extending between the lower edges of adjacent modules 4 are loaded in tension and resist separation of the individual modules 4. Because the box beam 60 is the primary weight carrying member, the longitudinal members can be relatively thin and flexible and easy to fabricate.

2 Claims, 10 Drawing Sheets

MODULAR STAIRCASE

CROSS REFERENCE TO PENDING APPLICATION

This application is a continuation of prior application Ser. No. 08/592,640 filed Jan. 26, 1996, now U.S. Pat. No. 5,720,136.

BACKGROUND OF THE INVENTION

1. Field of the Invention

This invention relates of stairways or staircases between different floors or levels in a building and to a method for constructing such stairways. More particularly, this invention relates to stairways that can be curved or spiral or helical. This invention also relates the use of preassembled modular components that can be used for assembly of such a staircase.

2. Description of the Prior Art

Conventional stairs, stairways or staircases are typically assembled in place. Although the individual components can be fabricated on site, finished interior stairs can also be assembled from prefabricated parts, including stringers, treads and risers. One stringer, or stair carriage, is located on each side of a conventional staircase. These conventional stringers extend between a lower level or floor and an upper level or floor and in some cases these conventional stringers are only supported at the ends. More frequently these conventional stringers are supported by one or more vertical supports, such as walls or columns, between the ends. Conventional stringers carry the weight of the staircase and the weight of any body that is carried by the staircase. These conventional stringers are therefore load bearing members and must be sufficient to withstand the bending moments that result from the application of gravitational forces or weights intermediate the ends and between vertical supports. Although the cross sectional area of these stringers will depend upon the size of the staircase, and of course upon applicable building codes and safety margins, it is not uncommon to use 2×12 inch wooden planks for stringers in conventional straight stairways. Conventional stringers in turn support individual treads, the horizontal member of a step in a staircase, and risers, the vertical member extending between steps or treads, that are positioned in notches on the inside of spaced stringers.

The stringers used for straight stairways are simple straight members with notches or a stepped configuration to support the treads. Conventional circular stairways are more complex, because they employ two curved stringers that are more complicated to fabricate. For conventional circular stairways, the curved stringers carry the weight of the stairs and the weight of any body supported by the stairway and must be strong enough to withstand these resulting bending loads. However, a single wooden member of sufficient thickness cannot be formed about a radius of curvature for a circular, helical or spiral staircase. Curved wooden stringers of this type are therefore conventionally fabricated by using a number of thinner strips that can be curved or formed. The strips are then glued together to form a laminated curved load or weight bearing stringer.

One technique for fabricating these stringers in a factory is to first construct support walls with appropriate curvatures. The innermost thin stringer components are then secured along their length to the support walls in successive layers and glued in place to form the curved laminated stringers. The temporary walls are then disassembled and notches or dados for risers and treads are then cut into the laminated stringers. These long curved stringers must then be assembled in a controlled environment and transported to the building site where the final stairway is installed. This technique is relatively expensive because the temporary support walls themselves represent a capital cost as well as an additional material cost, their assembly and disassembly is a direct labor cost, and production capacity and space must also be provided. Quite often special temporary support walls must be constructed for each unique configuration. Secondary, but costly, operations, such as notching or dadoing the laminated stringers are susceptible to error or inaccuracies and add cost. Skilled labor is necessary to make compensating adjustments during assembly. Components are not easily assembled by laborers inexperienced in this craft. It is impractical to construct and assemble a circular stairway using inexperienced labor outside of a controlled shop environment. Shipping these long curved stringers is also impractical.

One approach using this same basic technique to fabricate curved stringers on the building site is however disclosed in U.S. Pat. No. 4,918,799. That patent discloses the use of upper and lower metal patterns in the form of radially extending rays in which corresponding rays are connected by vertical beams. These vertical beams serve the same function as the temporary cylindrical support walls in the factory assembly technique just described. The laminated stringer sections are secured to the vertical beams in a helical pattern and the curved laminated load bearing stringers are fabricated. The metal beams and upper and lower radial supports are then removed. This approach reduces the cost of building special temporary walls and eliminates shipping costs when this technique is used on site. However, this approach is still relatively time consuming and the quality of the final structure is dependent upon the skill of the craftsman. Curved stairways built by this method still represent a significant expense.

Another approach that can be used to construct conventional curved laminated load bearing stringers is shown in U.S. Pat. No. 5,347,774. That patent shows fabrication techniques that do not employ temporary support walls, beams or other temporary forms to fabricate the stringers. That patent discloses the use of step structures to create the desired stringer curvature. One technique disclosed in that patent uses laminated stringer starter strips that are approximately one/fourth (¼) inch thick and can be bent by hand. The starter stringer strips are inserted into notches on the lower surfaces of the treads and screwed to the treads. The notches on the treads are formed so that the starter stringer strips are formed to the proper curvature by assembly to the successive treads. Elongated reinforcing structures are then secured to the inner surfaces of the starter stringer strips to laterally thicken and strengthen the starter stringer strips. These laminated reinforcing structures are preferably formed by sequentially gluing wooden strips to form a laminate. A second related method of fabricating laminated stringers is disclosed in U.S. Pat. No. 5,347,774. In the second method the tread-riser subassemblies are laid out and supported by temporary columns or temporary supports. The curved laminated stringers are then fabricated, one layer at a time, below the tread-riser subassemblies using the temporary columns as a form, much in the way that temporary support walls or metal beams are used in other prior art methods of assembling stringers. These laminated stringers are then pulled together with the tread assemblies each consisting of one preassembled tread and riser. In actual practice, screws, clamps and glued wedges may he necessary. However, the use of either of the methods disclosed in U.S. Pat. No. 5,347,774 means that the laminated stringers must still be built up one layer at a time, a relatively time consuming process. If these methods are used in a factory environment either the complete, bulky staircase must be shipped or the staircase must be disassembled and shipped. Even if the staircase is disassembled and shipped, the laminated stringers are still large and bulky and difficult to ship. If these assembly techniques are used at the building site to construct the staircase, the time required to laminate the stringers can interfere with other jobs at the building site.

Another prior art technique for constructing a curved staircase is disclosed in U.S. Pat. No. 4,869,034 where the stringers are fabricated from separate interfitting blocks. The blocks are shaped substantially like a parallelogram with beveled vertical ends. The blocks are strung together using a tensioned cable that is threaded through channels in each block. Cable grippers are installed in each block to prevent the cable from being withdrawn. The blocks can also be bolted together. Shear pins and dowels must be inserted between adjacent blocks to prevent relative vertical displacement between the blocks and to counteract significant shear forces. Treads are inserted into slots on the inside of two opposed blocks. Each tread extends into aligned notches in adjacent blocks on each curved stringer to help withstand shear forces.

SUMMARY OF THE INVENTION

A primary object of this invention is to permit the construction of stairways, especially stairways with curved or complicated designs, from pre-engineered modular components. These modular components should be easy to ship and should be of a relatively standard design so that the components could be maintained in inventory or easily prefabricated from standard designs. It should be possible to ship stairways in kit form. Subcomponents should be easy to fabricate and should preferably be fabricated using numerical or computer controlled techniques that permit the design of a stairway engineered for specific applications. The only variables for the principal modular components should be size and curvature. It should be possible to assemble straight, curved, helical and spiral stairways curving through 360 degrees. Preferrably the components should be shipped to a building site and the staircase should be assembled for the first time at the building site, eliminating the need for preassembly at the factory or warehouse.

Another object of this invention is that the components forming the stairway should be simple to assemble so that relatively unskilled labor could be employed at the building site. It should be possible to include registration or alignment means so that the components could be fitted together without the need to cut or trim the modules or other components. The components should therefore use only assembly techniques that would be commonly used and should be substantially the same as traditional wood fabrication techniques. It should also be possible to assemble the individual components from commercially available materials, such as plywood.

Another objective is that the same basic modular components could be used to assemble freestanding stairways and stairways that are supported on one or two sides by walls or by support columns. It should also be possible to construct a spiral stairway rotating about 360 degrees without the need for a center support column. No nonstandard means of attaching the stairway at either the upper or lower level or floor should be necessary.

One significant advantage of the invention disclosed and claimed herein is that a stairway, either straight or curved, can be constructed without the need for stringers that support the weight of the staircase or the weight of any body that is supported by the stairway. For curved stairways or stairways of complicated design, this eliminates the need for a laminated curved stringer that has sufficent stength to support these gravitational forces, significantly reducing the cost and time to construct relatively complicated stairways.

Of course the assembled stairway must support its own weight as well as the weight of any body placed on the stairway in a manner consistent with normal building codes and safety margins. The stairway must also be durable and last for the anticipated life of the structure in which it is employed. The stairway should also be suitable for use as a main finished stairway in a residence or commercial installation, and it should be possible to either construct the stairway out of a wide variety of premium materials or to apply a veneer to structural components fabricated from less expensive materials.

The instant invention disclosed and claimed herein accomplishes each of these objectives and overcomes other limitations in the prior art by employing an assembly of load bearing cells or modules to assemble the stairway. Each cell or module includes a front and rear panel and the front panel of one module is affixed, bonded, attached, screwed, nailed or glued to the rear panel of the next lower module. Front and rear panels are rigidly attached so that the modules are load bearing. Adjacent modules are assembled in a stepped configuration so that each front panel extends above the rear panel to which it is affixed to form the riser between steps. Treads are mounted on top of the modules.

The front and rear panels of each module are joined by transversely extending inside and outside panels and braced by supporting panels located on the top inside of each module to prevent racking of the module. For a curved stairway, these individual modules have a trapezoid or pie shape with the front panel diverging from the rear panel from the inside to the outside of the curvature. Registration means, such as dowel pins and holes, can be used to align the panels and to simplify assembly.

The modules are assembled as a box beam, helical in case of a curved stairway, and this box beam configuration supports the weight of the stairway and of any body on the stairway, but the lower portion of the joints between adjacent module panels do tend to expand. Longitudinal members, such as boards that can run the entire length of the stairway, are positioned to extend between adjacent modules to resist this load. These longitudinal members are loaded primarily in tension. Because the box beam is the primary weight carrying member, longitudinal members need not support the weight of the stairway and the weight of any body on the stairway and do not carry bending loads in the same manner as conventional stringers. These longitudinal members can therefore be thinner and more flexible and are therefore easier to fabricate and less expensive.

Individual modules can be prefabricated and shipped to the job site along with necessary supplemental members, such as treads, finish members and the longitudinal members. The stairway can then be easily assembled by using dowel pins to align adjoining modules and securing modules by gluing corresponding front and rear panels together. Mechanical fasteners, such as screws, can then be added for redundancy. After a helical box beam has been assembled from the modules for a curved stairway, longitudinal members can be flexed and positioned along the bottom of the box beam. The longitudinal members need not be fabricated as a curved laminated structure in the same manner as prior art conventional curved weight supporting stringers. Treads can then be attached to the top of each module and an exterior finish or veneer covering can be attached.

Although this approach is especially useful for curved stairways, it can also be employed for 360 degree spiral stairways, for short winder sections and even as an easily assembled modular straight stairway. The stairway can be freestanding and supported only at the top and bottom levels or intermediate supports, including load bearing walls can be used. A preferred embodiment of a curved stairway depicting the primary features of this stairway will now be described.

DETAILED DESCRIPTION OF THE PREFERRED EMBODIMENT

The preferred embodiment of this invention is a curved freestanding stairway fabricated entirely of wood. This curved freestanding embodiment is more comprehensive than other versions currently comtemplated and is therefore disclosed as representative of this invention even though not all of the elements of this embodiment are included in some of the simpler and broader embodiments of this invention. This stairway is suitable for residential or commercial use. Although a curved embodiment is shown, straight and spiral staircases can use the same basic structure and construction or assembly techniques. Staircases having curved sections of different radii can also be fabricated in this manner. This invention can also be used to fabricate stairways of materials other than wood or that use a combination of wood and other materials. This invention can also be employed with non-freestanding staircases that are supported by walls on one or both sides.

Figure 1:
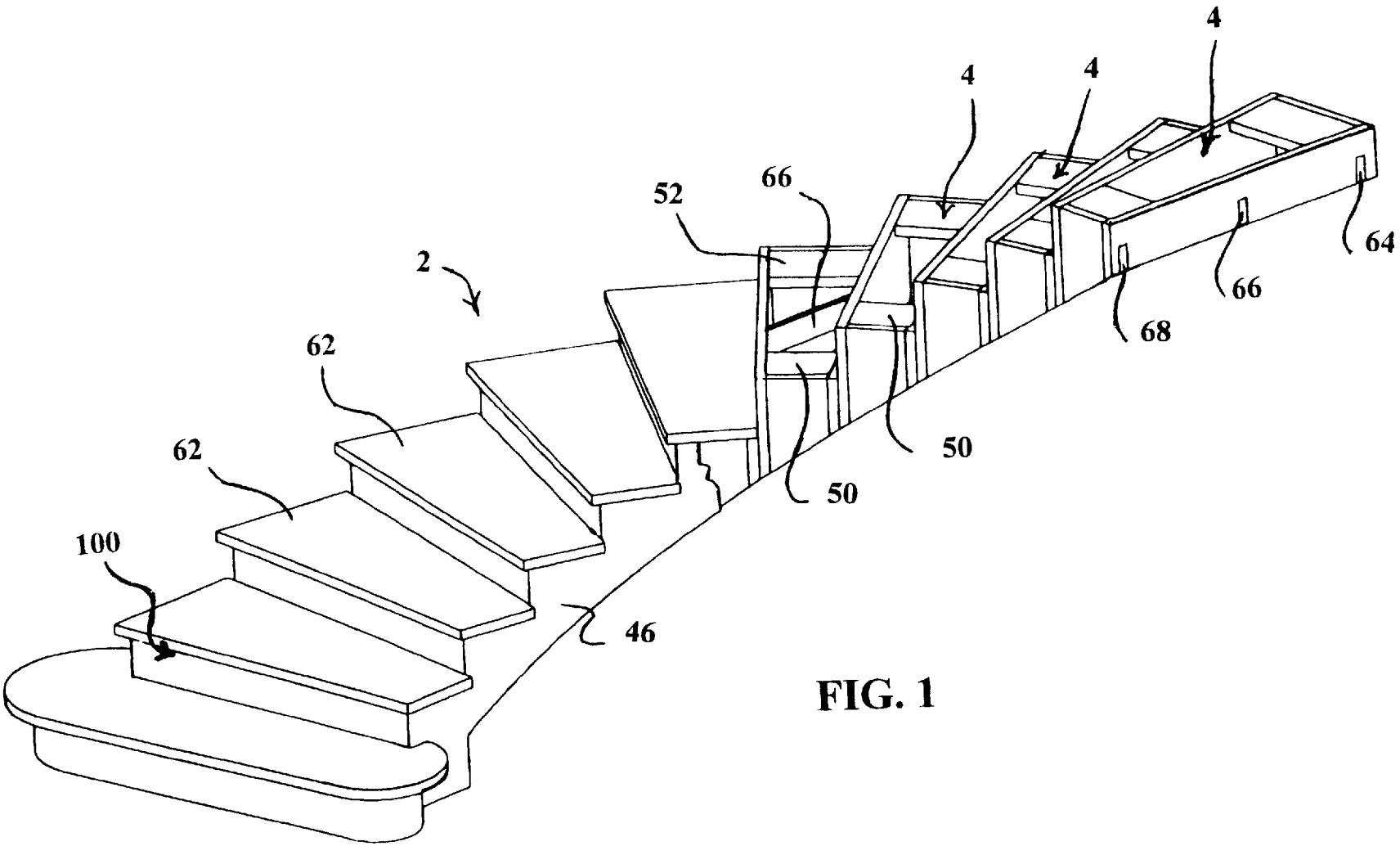
FIG. 1 is a perspective view of the preferred embodiment of a freestanding curved stairway, staircase or flight of stairs constructed from multiple load bearing modules.
Figure 2:
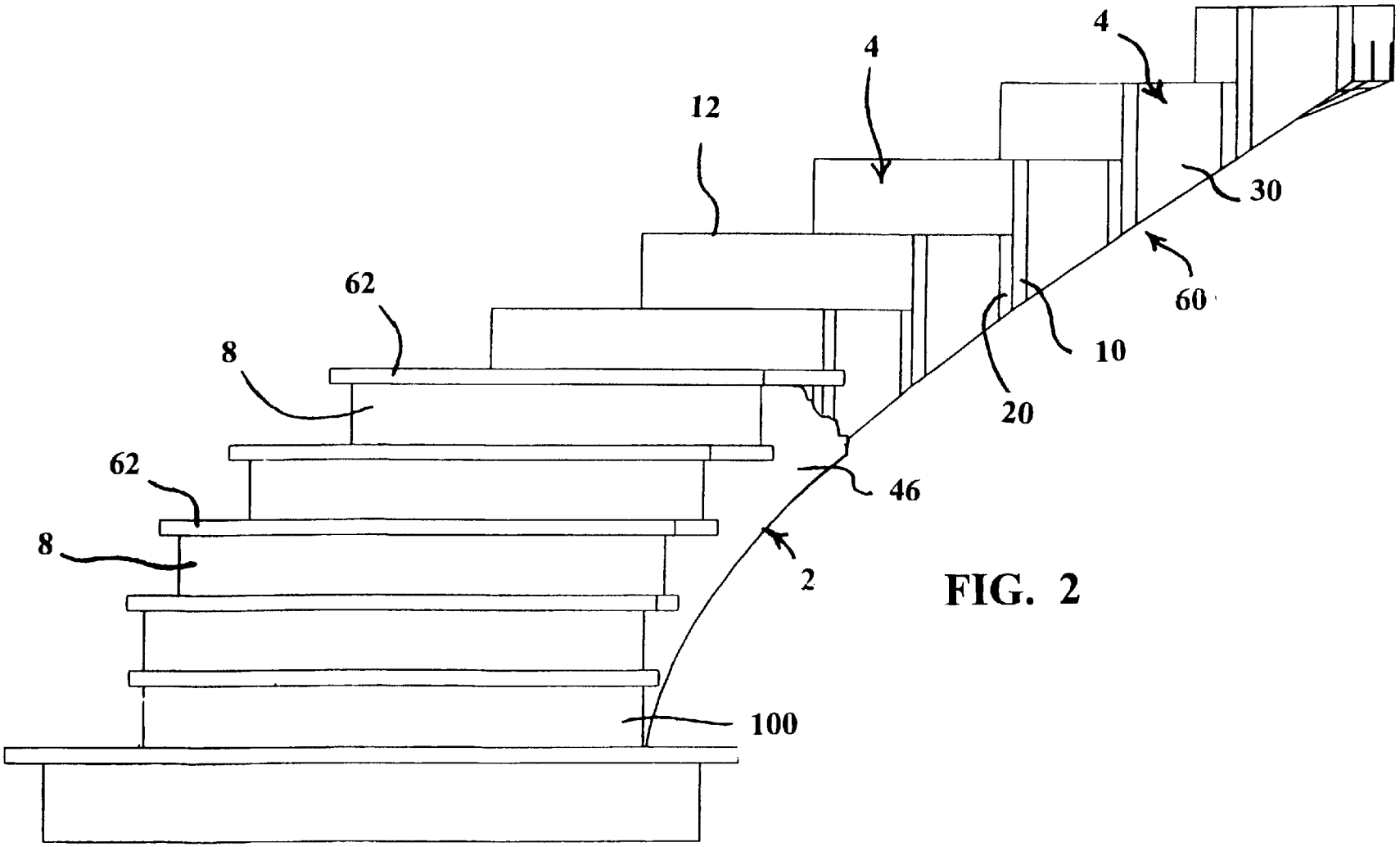
FIG. 2 is a front view of the stairway of FIG. 1.
Figure 3:
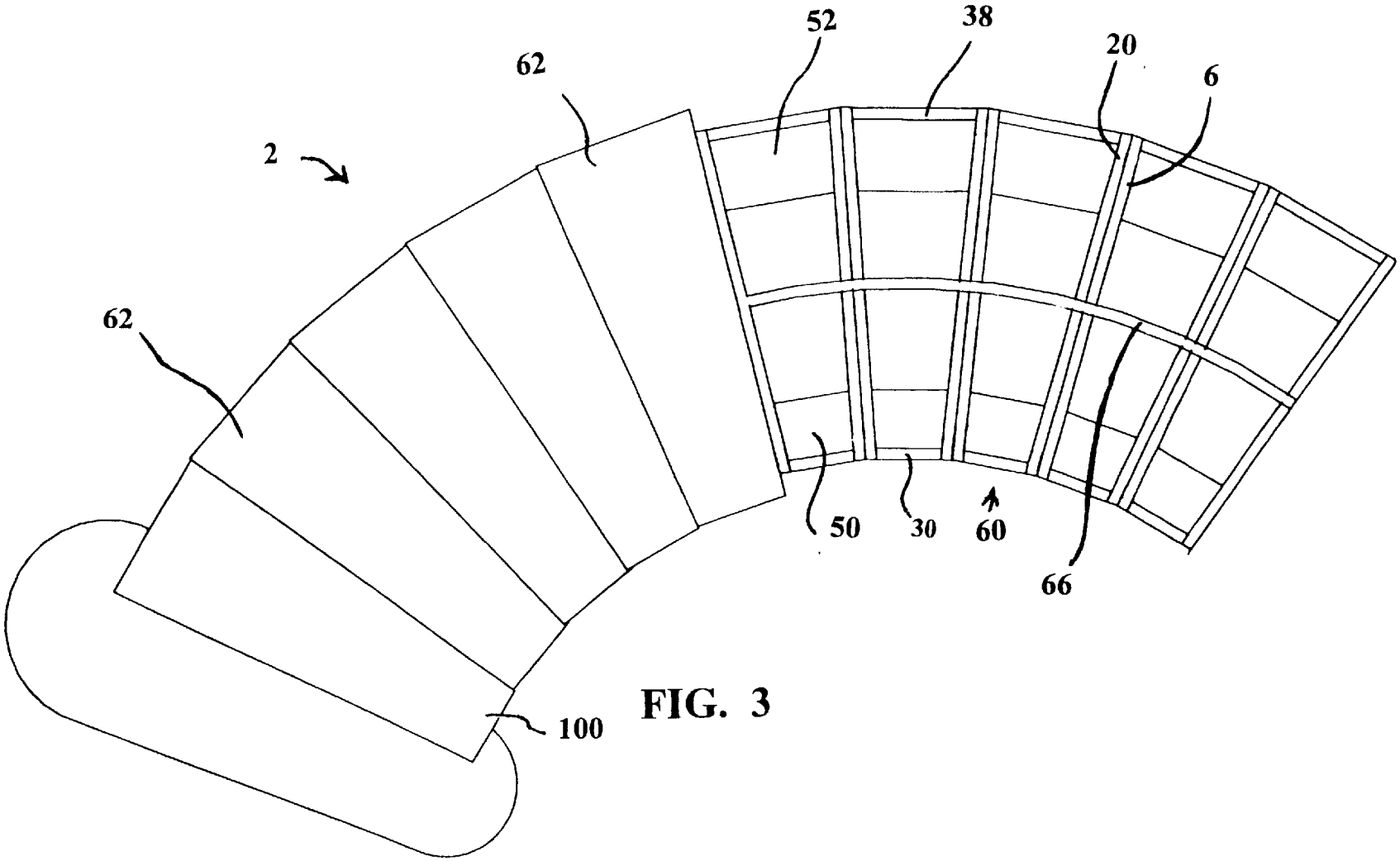
FIG. 3 is a top view of the stairway of FIG. 1.
Figure 4:
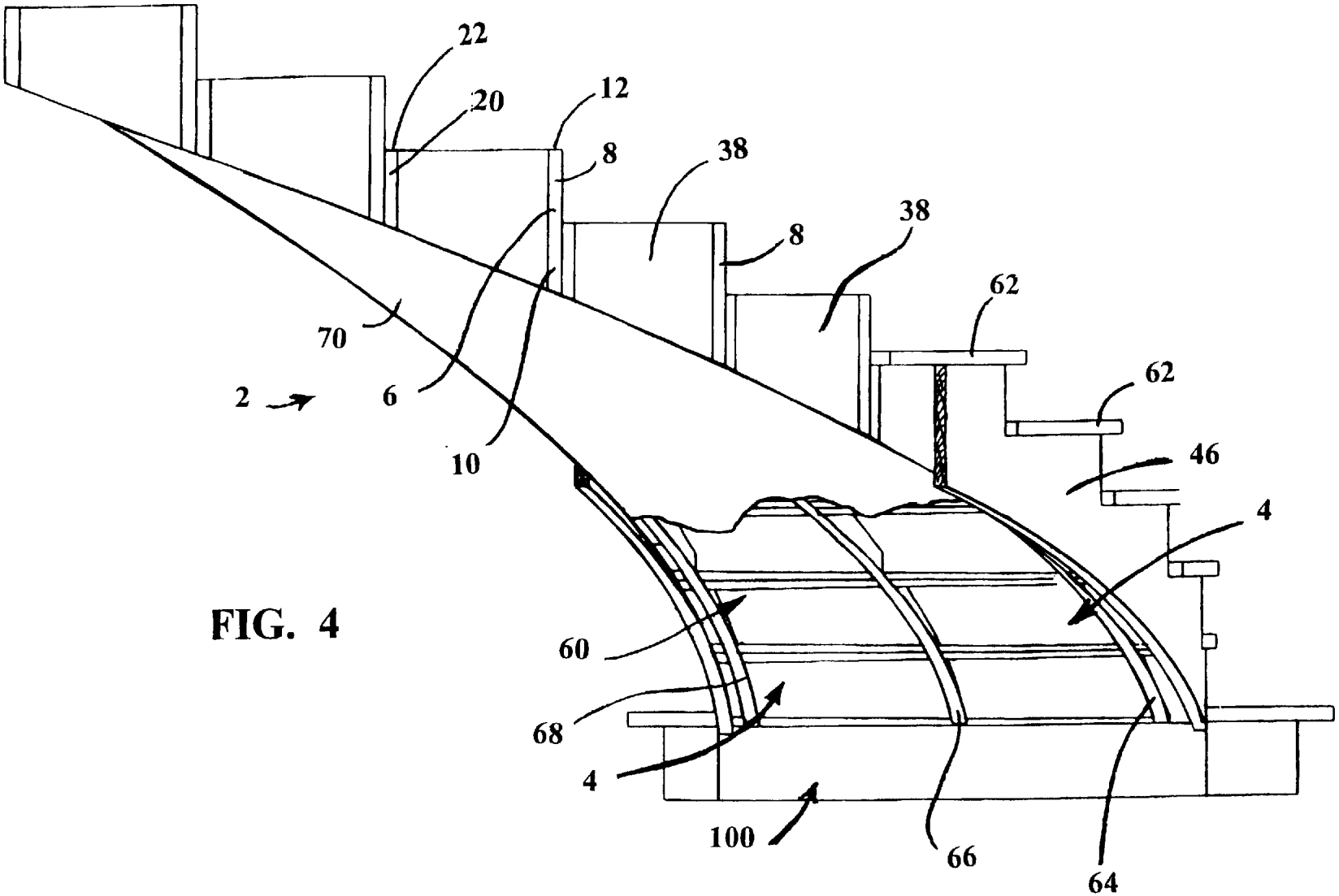
FIG. 4 is a rear view of the stairway of FIG. 1 showing three longitudinal members spanning the bottom of the modules.
Figure 5:
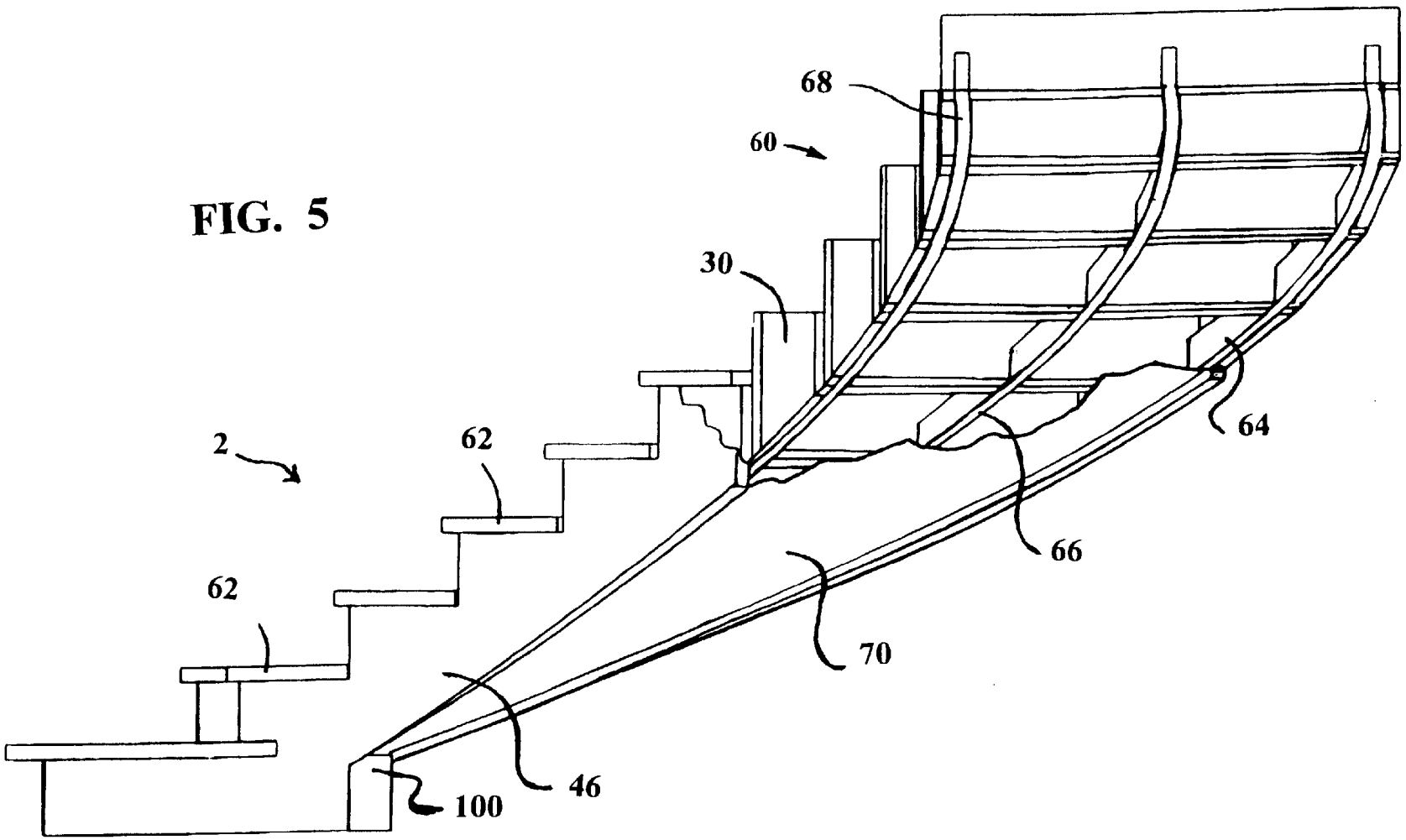
FIG. 5 is a side view of the inside radius of the stairway of FIG. 1.

Stairway, staircase, or a flight of stairs 2 shown in FIG. 1 is fabricated using a plurality of load bearing modules 4 that are assembled to form a helical box beam 60 that supports or carries the weight of the stairway 2 and the weight of any body, such as a person, positioned on the stairway. As used herein the term helical box beam refers to a load bearing assembly of multiple modules and is used to refer to this structure prior to completion or finishing of the stairway 2. In some instances the phrase helical box beam also includes certain additional elements, such as treads, that will be apparent from the context. A tread 62 is located on each cell or module 4 and an exterior finish member or veneer layer 46 is secured to both sides of the helical box beam 60. Each of the modules 4 is identical for a stairway in which the centerline of the stairway maintains a constant radius of curvature. Stairways with variable curvature can employ modules with different curvatures. An end module 100 that differs slightly from the modules 4 is located at the lower end of the stairway 2. An initial step can be added to this end module.

The helical box beam 60 shown in FIGS. 2–5 is formed by sequentially assembling a plurality of individual modules 4 to each other. The helical box beam 60 shown in these views also includes one end module 100 at the bottom of the assembly. The modules or cells 4 are then assembled one at a time so that the front on one module 4 is affixed to the rear of the lower module with each module 4 being higher than the adjacent lower module 4 to form an ascending stairway. In addition to the modules 4 and the end module 100, this helical box beam includes three longitudinal members 64, 66, 68 located on the lower surface of the modules 4. These longitudinal members are in some respects only similar to conventional stringers. For example, the longitudinal members are located on the sides of the stairway and they extend parallel to the position otherwise occupied by conventional stringers. However, the longitudinal members 64, 66, 68 differ from conventional stringers because they are not intended to carry the weight of the stairway, nor are they intended to carry the weight of any body positioned on the stairway nor must they be laminated to resist the bending moments due to the weight of the stairway and of any body on the stairway. In other words, the resulting bending loads would not be transmitted to these longitudinal members 64, 66, 68 in the same way that conventional stringers carry the bending stresses imposed by a stairway of conventional construction. Indeed the longitudinal members 64, 66, 68 of the preferred embodiment would not be able to carry such bending loads, or the combined weights of the stairway and any body to be supported by the stairway. Not only would longitudinal members 64, 66, 68 not be strong enough to carry the nominal weight of the stairway and any body to be supported by the stairway, these longitudinal members would not be able to support the weights required by building codes and acceptable safety margins. The helical box beam 60 would, however, be able to carry these weights, including the added strength required by applicable codes and safety margins. As used herein the weight of the stairway and the weight of any body to be supported by, carried by, or positioned on the stairway should be interpreted to include any additional weight mandated by building codes or safety margins dictated by accepted or good engineering practice. Since the longitudinal members 64, 66, 68 do not have to be as stong as conventional weight bearing stringers, they can also be thinner and more flexible. Indeed for the preferred embodiment of this invention, individual wooden 1×4 inch members of yellow pine or similiar standard material that can be flexed to conform to the radius of curvature of a standard stairway can be used as longitudinal members 64, 66, 68. Therefore it is not necessary to build up curved laminate stringers to support the weights required for a stairway. These longitudinal members can however be assembled using several boards. Although longitudinal members 64, 66, 68 do not function as conventional stairway stringers, they are nevertheless members that extend along or parallel to the axis of the stairway 2 or helical box beam 60.

Figure 6:
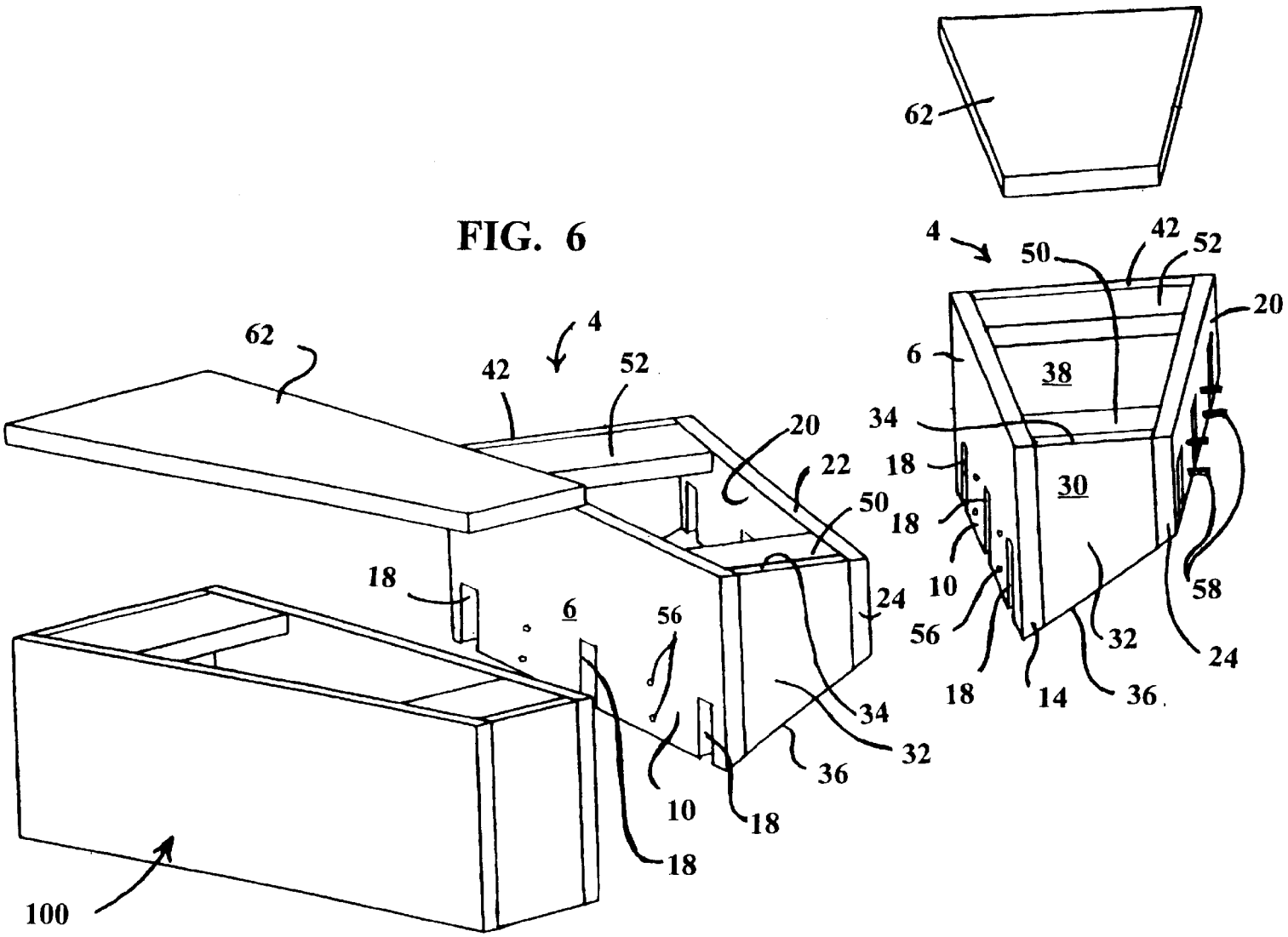
FIG. 6 is an exploded view, from the inside radius, of the modules and the treads that are assembled to each module.
Figure 7:
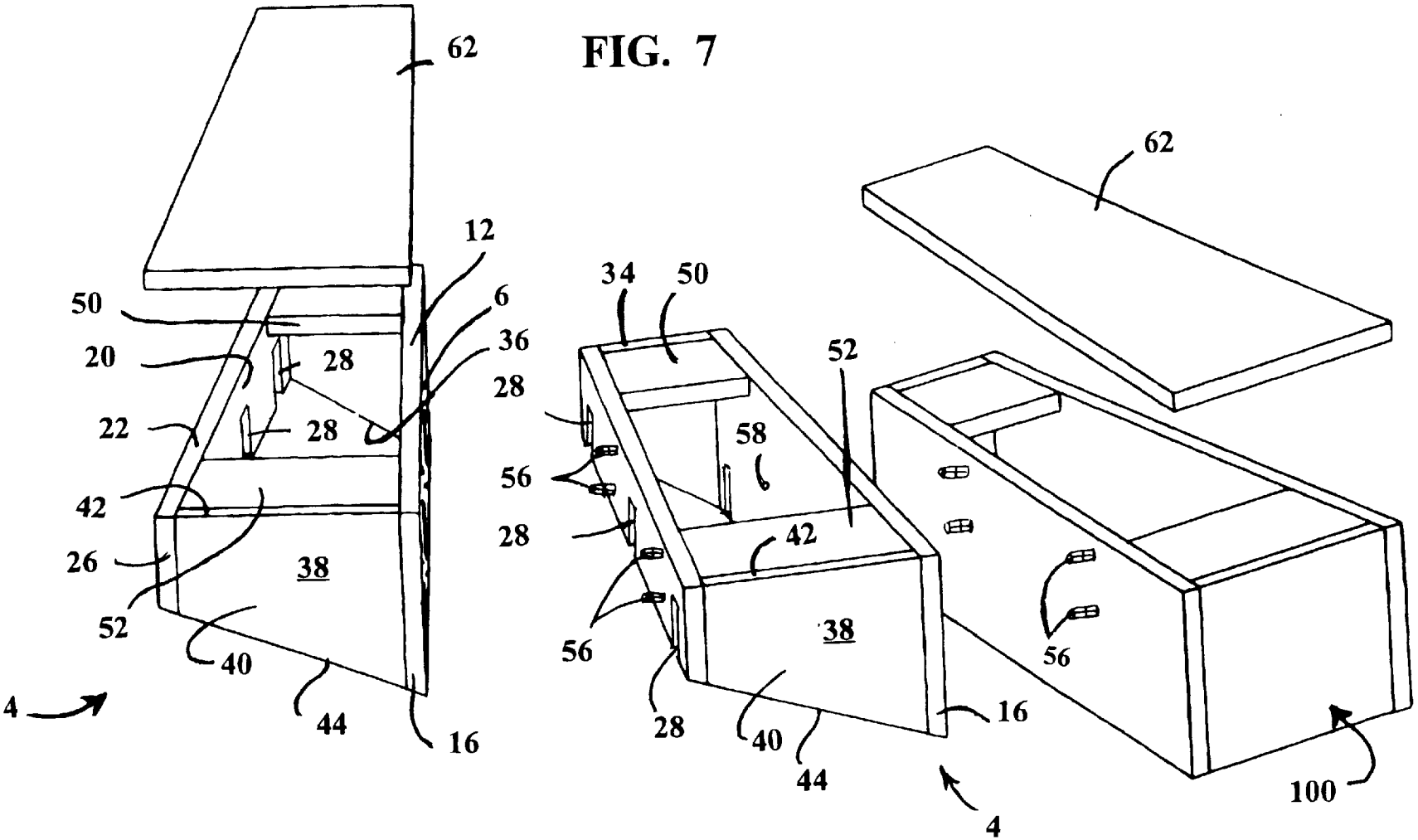
FIG. 7 is an exploded view, from the outside radius, of the modules and the treads that are assembled to each module.

FIGS. 6 and 7 show inside and outside views of two standard curved modules 4 and one end module 100. Each standard module 4 includes six panels that can be constructed of commercially available material such as commercial grade three-quarter (¾) inch plywood. A vertical front panel 6 is joined to a vertical rear panel 20 by a transversely extending vertical inside panel 30 and a transversely extending vertical outside panel 38. Both the front panel 6 and the rear panel 20 extend to the outer edge of each module 4. In the preferred embodiment, the inside front panel edge 14 and the outside front panel edge 16 are flush respectively with the inside and outside of each module 4 and are flush with the outwardly facing inside panel surface 32 and the outwardly facing outside panel surface 40. Similarly the inside rear panel edge 24 and the outside rear panel edge 26 are flush with these same outwardly facing inside and outside panel surfaces. In the preferred embodiment, the front and rear panels 6 and 20 can be attached to the inside and outside transverse panels 30 and 38 by simple perpendicular joints in which screws are driven through the faces of the front and rear panels 6 and 20 into the ends of the inside and outside panels 30 and 38. A commercial adhesive or glue can also be used between mating surfaces. Since these screws are perpendicular to the front and rear panels 6 and 20 they do not form obstructions when two modules 4 are attached in the manner to be subsequently described. Other conventional wood joints, including mitered joints, mitered lock joints, or dovetailed joints, could also be employed if additional strength is needed for some applications, but for most applications only a simple screwed and glued perpendicular abutting joint is required.

Each module 4 also includes inner and outer support plates or bracing members 50 and 52 extending between the front and rear panels 6 and 20 respectively, and located adjacent the inside and outside panels 30 and 38. These support plates 50 and 52 are horizontal and abut each of the four vertical panels 6, 20, 30, 38 forming the exterior of the individual modules 4. The inside support or bracing member 50 is screwed and glued to the front panel 6, the rear panel 20 and the inside panel 30. The outside support or bracing member 52 is screwed and glued to the front panel 6, the rear panel 20 and the outside panel 38. The upper surfaces of these support or bracing panels is flush with the top front panel edge 12, the top rear panel edge 22, the top inside panel edge 34 and the top outside panel edge 42, all of which lie in a common horizontal plane. The support or bracing panels 50 and 52, abutting the inner sides of the four outer vertical panels prevent racking, or twisting about a vertical axis, of the module and stabilize each individual module 4. These support or bracing members 50 and 52 also provide a surface to which the treads 62 can be attached after assembly of the modules 4 to form the box beam 60.

Each of the standard modules 4 includes a front panel 6 that has a height greater than its corresponding rear panel 20. Since the top edges of the front and rear panels are positioned in the same horizontal plane, the lower portion of each front panel extends below the lower edge of the corresponding rear panel 20. The transverse inside and outside panels 30 and 38 therefore have upwardly slanted or inclined bottom edges 36 and 44 extending between the bottom edges of corresponding front and rear panels 6 and 20.

The modules 4 shown herein are intended for use in a curved stairway. Each module 4 therefore has a trapezoidal horizontal cross section. The front and rear panels 6 and 20 diverge as they extend radially outward to form pie shaped modules 4. The outside panel 38, located radially outward relative to the inside panel 30, has a width greater than the inside panel 30. Each of the modules is symetrical about a radial plane extending from the same center of curvature about which the stairway 2 and box beam 60 are curved and through the midpoint of both the inside and outside panels 30 and 38.

Figure 9:
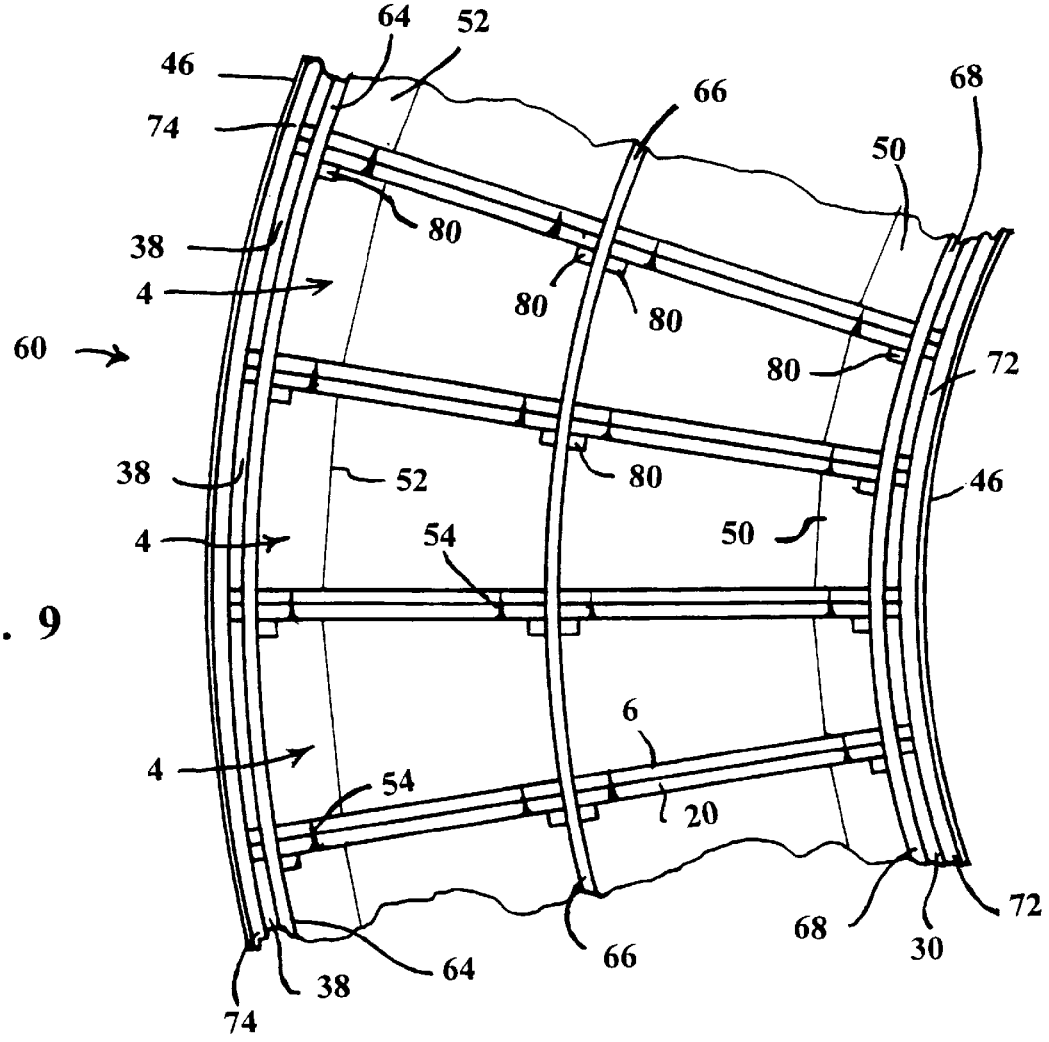
FIG. 9 shows an embodiment in which the side panels are curved and the longitudinal members are bonded to these curved side panels.

Both the front panel 6 and the rear panel 20 are flat between their inner and outer edges. In this embodiment the inside and outside panels 30 and 38 are also flat. As will be subsequently described the surfaces of the front and rear panels 6 and 20 are flat because the front panel 6 of one module 4 is to be attached to the rear panel 20 of an adjacent module. The flat surfaces of the inside and outside panels 30 and 30 result in a discontinuous, generally curved, surface made up of straight segments on the inner and outer sides of the box beam 20 and of a curved stairway 2. Flat inside and outside panels 30 and 38 thus form chord sections between radially extending front and rear panels 6 and 20. A finish member 46 will however be attached to cover these surfaces. In an alternate embodiment of this invention shown in FIG. 9, the initially exposed outwardly facing surfaces 32 and 40 can formed using curved plywood panels of uniform thickness or the panel could be machined to form a curved surface having a curvature corresponding to the local curvature of the stairway 2. These curved surfaces would conform to the curvature of a longitudinal member and a full mating glue bond is formed to secure the longitudinal curved member to the underlying helical box beam 60. The flat surfaces of the preferred embodiment should however be less costly and it is anticipated that they would be used in most applications.

Registration means are also provided on the front panels 6 and the rear panels 20 to assist in aligning two modules during assembly of the helical box beam 60. These registration means comprise one or more alignment holes 56 on each front and rear panel 6 and 20 and dowel pins 58 to be received in these alignment holes. In the embodiment depicted herein four alignment holes 56 are shown in each front and rear panel 6 and 20. It should be understood however that this array of four holes and pins is only representative. It would also be possible to include multiple sets of alignment holes in the front and rear panels 6 and 20. Only one set of alignment holes would be used for any one installation. However, multiple sets would permit use the same modules 4 in different stairways 2 having a different vertical spacing, rise, or yield between adjacent steps. In the preferred embodiment depicted herein, these alignment holes 56 and dowel pins 58 are intending only to provide alignment and registration and are not to be relied upon to support the modules 4 or to resist shear in the final stairway assembly 2. Of course other forms of registration means could be employed. For example, a template could be printed or attached to one panel and the other panel could be positioned relative to this template. Lines could also be scribed on the panels for alignment.

In the preferred embodiment, adjacent modules 4 are to be interconnected or secured to each other by affixing the lower front panel section 10, containing the alignment holes 56 to the rear panel 20 of an adjacent module. The upper front panel section 8 will then form the riser between the upper surface of a lower module and the upper surface of the next higher module. To secure two modules 4 together a commercial glue or adhesive, of the type commonly used in wood construction, is dispensed over the mating surfaces of a front panel 6 and an adjacent rear panel 20. The dowel pins 58 are then inserted in corresponding holes 56 on the adjacent front and rear panels 6 and 20, and the opposed panels are pressed together so that a bond is formed between the two panels. In the preferred embodiment mechanical fasteners, such as screws 54 are then used to secure the mating front and rear panels 6 and 20. Two independent means, the screws 54 and the glue bond affix two modules together. Preferably both the glue bond and the screws are independently capable of carrying any shear forces between the modules due to the weight of the stairway and due to the weight of any body to be positioned on or supported by the stairway 2, adding redundancy to the structure. Although the front and rear panels are flat to facilitate attachment, these mating surfaces need only have surfaces suited for mutual engagement. For example, curved front and rear panels could also be used.

Figure 8:
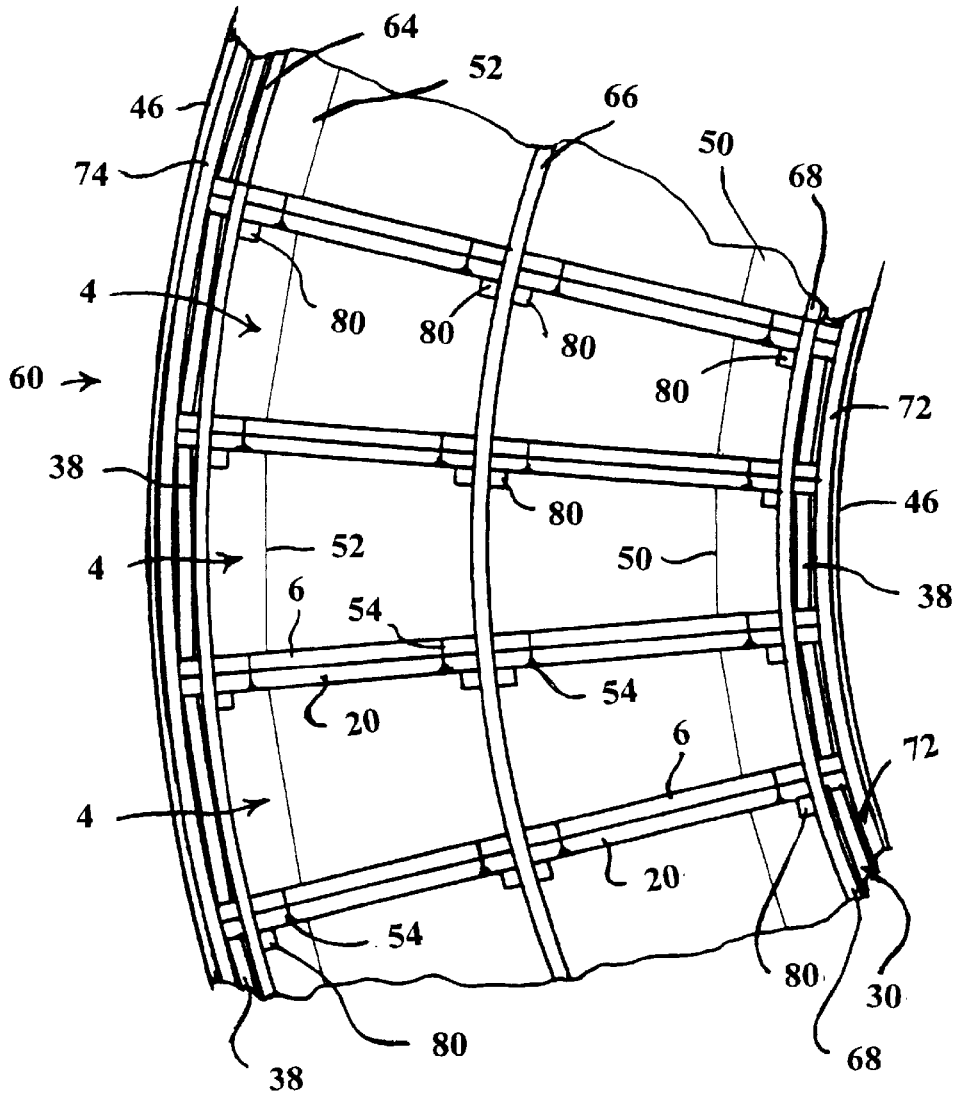
FIG. 8 shows the manner in which longitudinal members are positioned in notches on the lower surface and attached to the bottom of the modules.

As shown in FIGS. 6 and 7 each front panel 6 and rear panel 20 of modules 4 has three sets of notches 18 and 28 extending from the lower edge of the respective panel. Two sets of notches 18 and 28 are located adjacent the sides of the front and rear panel 6 and 20 and a third set of notches is located at the center of each front and rear panel. These notches 18 and 28 are aligned and will be located along a curved path in the final assembled stairway 2. Each notch 18 and 20 has a width sufficient to receive one of the longitudinal stringer or tension members 64, 66, 68 used in the final assembly of the helical box beam 60 and of the stairway 2. The manner in which these longitudinal stringers or tension members 64, 66, 68 are assembled to the modules 4 is shown in FIG. 8 and will be discussed with reference to the assembly of box beam 60 and stairway 2.

The modules 4 can be prefabricated and shipped to the site where the final stairway can be assembled. For a curved stairway 2, the individual modules each have a trapezoidal cross section which simplifies stacking and shipping since modules 4 can be stacked in an inverted relationship minimizing lost space. Auxiliary members such as dowel pins 58, treads 62, exterior finish members 46 and longitudinal members 64, 66, 68 can also be shipped from a manufacturing site to the assembly location or building site for the final stairway 2. Alternatively the longitudinal members 64, 66, 68, which can consist of commonly available boards or planks, can be cut locally to avoid the shipping cost of long bulky members. The exterior finish member 46 can also be fabricated locally. Modules 4 can be shipped from inventory for common configurations or they can by easily fabricated for specific orders. The only dimensional information needed would be the width, curvature and the total rise required. Modules 4 could then be simply and quickly manufactured at a central facility especially with the use of computer aided tooling.

The stairway 2 could be assembled from components either at a local assembly location or at the building site itself. When the stairway is assembled at the building site, it can be assembled in place or it can be assembled at a more accessible site location, such as on the opposite side of a room.

The stairway 2 is assembled from the bottom up. The end module 100 is initially attached to the first standard module 4. Note that the end module 100 will form one step. Typically a first step can be attached to the end module 100. The only significant difference between the end module 100 and the other standard modules 4 is that the lower surface of each end module panel is flat so that the end module can be placed on the floor. Standard modules 4 are then added one at a time by first applying glue or adhesive to the mating surfaces and aligning modules using dowel pins 58. Adjacent modules 4 are then screwed together. Note that the screws 54 would be inserted first through the lower section 10 of each front panel 6 and then into the rear panel 20. Screws 54 or other mechanical fasteners will therefore not be visible in the finished stairway. As the stairway is assembled, temporary vertical supports can be added. It is recommended that a 2×4 stud be used as a temporary support for each set of three modules. Of course these studs could be permanent if the stairway is not freestanding and is to be supported from below.

After all of the modules 4 have been assembled in this manner, the longitudinal members 64, 66 and 68 are then positioned in notches 18 and 28 on the lower surfaces of front panels 6 and rear panels 20. Since the longitudinal members 64, 66, 68 are not intended to support the weight of the stairway or the weight of any body to be positioned on the stairway, they can be relatively thin, and could be fabricated using a common material, such as yellow pine. The longitudinal members will then be flexible enough to fit within notches 18 and 28. In some cases glued up longitudinal members may be used. The two outside longitudinal stringer or tension members 64 and 68 are attached to the inside of adjacent inside and outside panels 30 and 38 as shown in FIG. 8. Screws are used to attach the longitudinal members to cleats 80 that are in turn attached to the front, rear or side panels respectively. These longitudinal members 64 and 68 used in the preferred embodiment are one-piece members and each is attached to each module 4 on opposite sides of mating front panels 6 and rear panels 20. The center longitudinal member is attached directly to each front and rear panel on the interior panel surfaces.

Any weight applied to the stairway will result in a force tending to separate the bottom portion of mating front and rear panels 6 and 20. In other words this weight would create compression at the top of mating modules, but would tend to cause expansion or separation at the lower edges. The longitudinal members 64, 66 and 68 would be loaded in tension as a result of this application of force and would tend to hold adjacent modules together at the lower edges. Although the longitudinal members 64, 66 and 68 could carry some bending loads, that is not their primary purpose. These bending loads would be primarily carried by the box beam formed by modules 4 with their four vertical walls 6, 20, 30 and 38. In addition to these functions the central longitudinal member 66 also stiffens the entire assembly and helps resist twisting about a vertical axis.

After the modules 4 have been assembled in this manner to form the helically box beam 60, the treads 62 are then positioned on top of each module and glued and or screwed to each module. Note that support plates or braces 50 and 52 provide relatively wide surfaces to which the treads can be attached in this manner. To add increased rigidity the inner edge of each tread is screwed to the front panel 6 of the next higher module 4. Thus treads 62 provide an additional point of connection between two adjacent modules 4 and the treads form an upper skin portion of the helical box beam 60.

The next step is the addition of the exterior finish member 46. The preferred method of adding this exterior finish or veneer member is to first attach exterior longitudinal members 72 and 74 to the inside and outside respectively of the modules 4 and helical box beam 60. The inside exterior member is screwed at the high points along the inside radius. These high points will be at the centerline of the inside panels 30 which will be tangent to the exterior longitudinal member 74. The exterior longitudinal member 74 will also be screwed to the high points along the exterior surface. Since the flat outside panels 38 will define chords along the curve of exterior longitudinal member 74, these high points will be at the juncture between two adjacent modules. When screwed in this manner, the exterior longitudinal members 72 and 74 will form a smooth curve along the exterior surface of the stairway 2 and box beam 60. Exterior longitudinal members 72 and 74 can be attached at one or more vertical locations. The exterior finish member 46 is cut in a sawtooth pattern to conform to the lower surfaces of the treads 62 and when screwed to the exterior longitudinal members 72 and 74, a finish members will form a smooth curve on the sides of the stairway 2. The finish member will also fit the lower surface of the treads 62 so that no jagged edges will be visible. Note that if inside and outside panels with curved exterior surfaces are employed, exterior longitudinal members 72 and 74 are not needed for this purpose.

For the freestanding stairway 2, a lower skin or plate or covering 70 is attached to the bottom of the helical box beam 60 including the longitudinal members 64, 66, 68. This lower skin 70 adds rigidity, but functions primarily as a finish or veneer for the stairway. However even a finish or veneer will add stability to the finished stairway by helping to join the individual modules 4 into a complete structural assembly. An outer covering 70 of sufficient strength can also comprise the longitudinal member holding the expansion joints between modules together, and in some applications this longitudinal outer covering 70 can replace the longitudinal stringer members 64, 66, 68. This outer covering or skin can comprise a single plywood sheet, although in most applications, several sheets would be used.

Although the preferred embodiment of this invention is a freestanding staircase that is supported only at the top and bottom end without intermediate supports, this invention is not limited to freestanding configurations. For instance, modules 4 can be used in a stairway that is supported on one of both sides by a wall or by intermediate posts or columns. If the modules 4 are supported on both sides by walls below the stairway there is no need for the side longitudinal stringer members 64, 68 and the center longitudinal stringer member 66. In an embodiment where walls support the stairway, the walls would provide a reaction force against the tendency of the lower ends of the modules 4 to separate under the influence of the weight of the stairway and the weight of any body positioned on the stairway. Even if the walls supporting the stairway were load bearing walls, the benefits of modular construction would still be applicable. Furthermore the walls below the modular stairway need not be load bearing in the sense that the walls would support the weight of the stairway and the weight of any body positioned on the stairway. The load bearing modules could still be assembled as a load bearing helical box beam with the walls stabilizing the expansion joint at the bottom of the module unctures. This approach could also be used with a stairway supported on one side by a wall and freestanding on the opposite side. A longitudinal stringer member should be used on the exposed side of a staircase supported on the other side by a wall. A central longitudinal stringer member would also stabilize a stairway supported on only one side by a wall.

Figure 10:
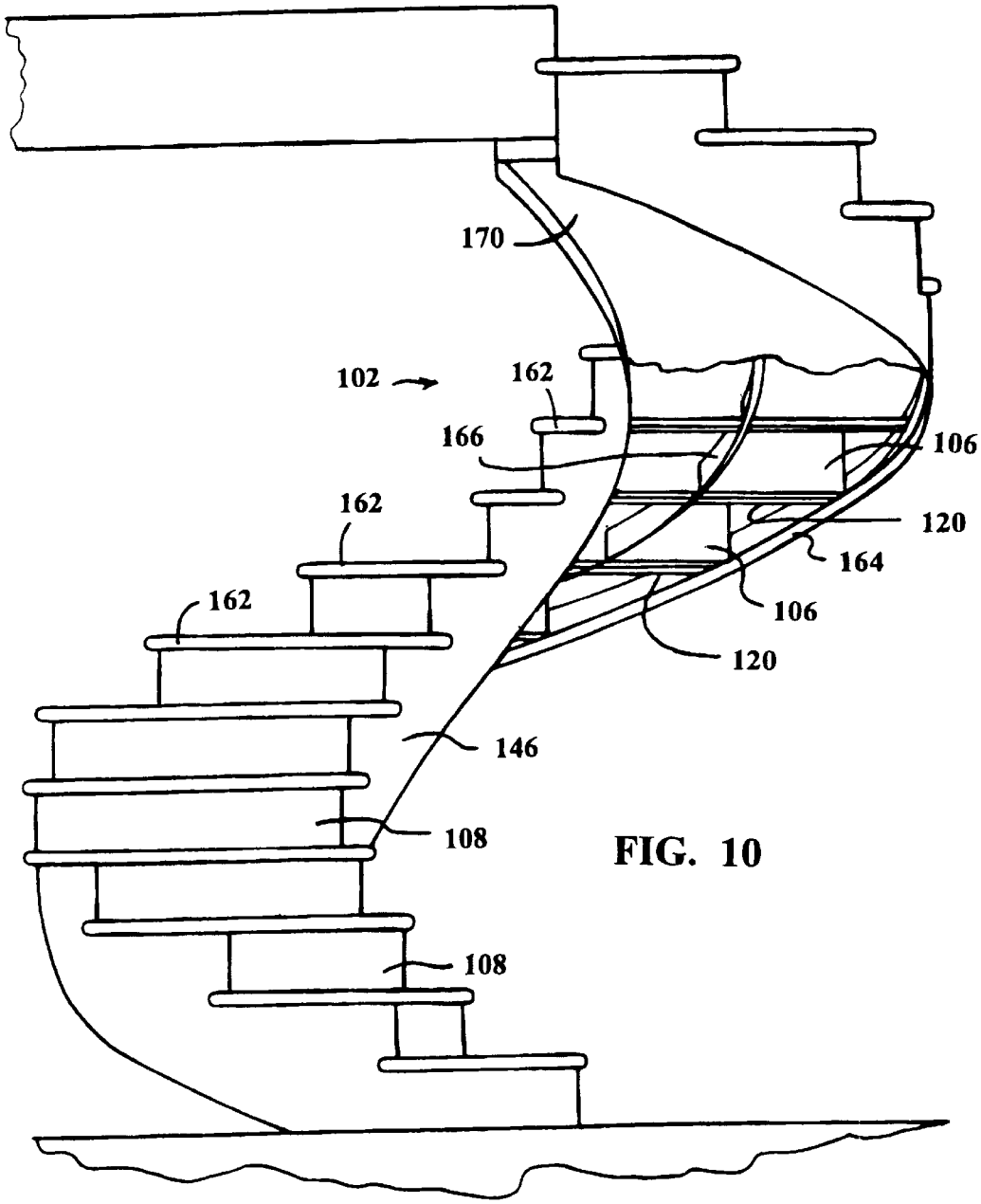
FIG. 10 shows an alternate spiral free standing embodiment of this invention in which the staircase extends around 360 degrees and does not employ a center post.

This modular construction could also be employed for straight stairs and a curved stairway having straight sections. The curved stairway of the preferred embodiment can also be continued to form a spiral staircase rotating completely around 360 degrees. A spiral staircase of this type would not require a center post since the helical or spiral box beam would still function as the load bearing member. FIG. 10 shows an alternate embodiment of this invention in which the stairway 102 forms a spiral rotating through 360 degrees about a vertical axis between lower and upper floors. Elements of this structure are identified by reference numerals 102 et seq. and elements that correspond to elements of the embodiment of FIG. 1–9 use corresponding numerals. For example, modules 104 correspond to modules 4. Modules 104 are rigid load bearing members in the same manner as modules 4 and these modules are attached to each other in the same manner to form a spiral freestanding beam. Adjacent modules 104 are attached by securing the front panel 106 of each module to rear panel 120 of the adjacent lower module. Modules 104 also have a generally traprazoidal cross section with the front panel 106 diverging from the rear panel 120. Spiral staircase 102 also does not apply conventional load bearing stringers or center posts to support the staircase and any body on the stairs. Longitudinal members 164, 166 and an inner longitudinal member (not shown) are attached to the bottom of the modules 104 and are loaded primarily in tension to prevent separation of adjacent modules due to the weight of the stairway and the weight of any body on the stairs. Treads 162 are mounted on top of corresponding modules 104 above the riser sections 108, finish members 146 are mounted on the exterior of module side panels, and a skin 170 is attached to the lower surface of this freestanding stairway 102. These modules 104 can be assembled on site and dowel pins or other registration means can be used to align adjacent modules 104 before they are secured by adhesives and fasteners, such as screws.

This invention has been described by referring to a primary embodiment of a curved stairway that illustrates its basic principles. Some alternative configurations have also been described, but the invention is not limited to the preferred embodiment or to these specific alternatives. It would be especially apparent to one skilled in the art that some individual components could be modified without departing from the essence of this invention. For example, a wood metal composite structure, or a structure using composite materials, could be fabricated using metal strips instead of the wooden longitudinal members or a cable could be used to replace these longitudinal members that serve primarily as tension members. Therefore the following claims are not limited to the specific embodiments described and discussed herein.

I claim:

1. A load bearing module for use with a plurality of other modules in constructing a stairway; the load bearing module including a front panel and a rear panel, both the front and rear panels extending between opposite sides of the module, the front panel and rear panel being mutually positioned for supporting a tread to be mounted on top of the module, at least a lower portion of the front panel and at least an upper portion of the rear panel being shaped for mutual engagement so that the lower portion of the front panel of the module can be attached to the upper portion of a rear panel of an adjacent module with adjacent modules in a stepped configuration, the front and rear panels of the module being spaced apart and rigidly joined by side panels and by bracing panels adjacent each side panel and adjacent the top of the module to from a rigid module so the loads applied to the load bearing module are supported by the panels of the module, the front panel, the rear panel, and the side panels each comprising separate wooden members attached together to form a multipart load bearing module, the bracing panels each being attached to the front and rear panel and to the side panel to which the bracing panel is adjacent.

2. The load bearing module of claim 1 wherein the front and rear panels are flat so that the lower portion of each front panel and the upper portion of each rear panel are shaped for mutual engagement, the front and rear panels being rigidly joined by a flat inside panel and a flat outside panel, the front and rear panels diverging between the inside panel and the outside panel so that each module has a trapezoidal cross section so that multiple modules can be attached to form a curved stairway.

* * * * *